US008660275B2

(12) United States Patent
Buck et al.

(10) Patent No.: US 8,660,275 B2
(45) Date of Patent: Feb. 25, 2014

(54) MICROPHONE NON-UNIFORMITY COMPENSATION SYSTEM

(75) Inventors: Markus Buck, Biberach (DE); Tim Haulick, Blaubeuren (DE)

(73) Assignee: Nuance Communictions, Inc., Burlington, MA (US)

( * ) Notice: Subject to any disclaimer, the term of this patent is extended or adjusted under 35 U.S.C. 154(b) by 329 days.

(21) Appl. No.: 13/273,816

(22) Filed: Oct. 14, 2011

(65) Prior Publication Data

US 2012/0106749 A1 May 3, 2012

Related U.S. Application Data

(63) Continuation of application No. 11/271,503, filed on Nov. 12, 2005, now Pat. No. 8,064,617, which is a continuation-in-part of application No. PCT/EP2004/005147, filed on May 13, 2004.

(30) Foreign Application Priority Data

May 13, 2003 (EP) ..... 03009852

(51) Int. Cl.
*H04R 3/00* (2006.01)

(52) U.S. Cl.
USPC ..... 381/92; 381/91; 381/122

(58) Field of Classification Search
USPC ..... 381/91, 92, 93, 122, 313, 317, 318, 381/94.1, 94.2, 94.3
See application file for complete search history.

(56) References Cited

U.S. PATENT DOCUMENTS

2005/0276423 A1* 12/2005 Aubauer et al. ..... 381/92

* cited by examiner

*Primary Examiner* — Vivian Chin
*Assistant Examiner* — Paul Kim
(74) *Attorney, Agent, or Firm* — Daly, Crowley, Mofford & Durkee, LLP

(57) ABSTRACT

A microphone compensation system responds to changes in the characteristics of individual microphones in an array of microphones. The microphone compensation system provides a communication system with consistent performance despite microphone aging, widely varying environmental conditions, and other factors that alter the characteristics of the microphones. Furthermore, lengthy, complex, and costly measurement and analysis phases for determining initial settings for filters in the communication system are eliminated.

28 Claims, 13 Drawing Sheets

MICROPHONE NON-UNIFORMITY COMPENSATION SYSTEM

TECHNICAL FIELD

This application is a Continuation Application of and claims priority to application Ser. No. 11/271,503, filed on Nov. 12, 2005. Furthermore, application Ser. No. 11/271,503 claims priority to and is a Continuation-in-Part of International Application No. PCT/EP2004/00514, filed May 13, 2004 and published in English as International Publication No. WO 2004/103013 A2. International Application No. PCT/EP2004/005147 claims priority to European Application 03009852.9, filed on May 13, 2003. The present Continuation Application claim priority from and incorporates all of the previously mentioned priority applications by reference in their entirety.

BACKGROUND ART

This invention relates to signal processing systems. In particular, this invention relates to compensating non-uniformity among microphones in a multiple microphone system.

RELATED ART

Microphones used in signal processing systems often have non-uniform characteristics. For example, the microphones in a hands-free voice command or communication system in an automobile may detect the same speech signal, but nonetheless produce very different microphone output signals. Non-uniform microphone characteristics may result from variations in the microphone fabrication process, from changes arising in the microphones from age, use, temperature, humidity, altitude, or from other factors. Non-uniform microphone characteristics may result in non-uniform frequency response between microphones, reduced signal strength and sampling accuracy, inconsistent sampling of sound signals, and generally reduced system performance.

One past attempt to compensate for microphone non-uniformities relied on pre-configuring digital filters with invariant initial settings to process the microphone signals. The initial settings depended upon the frequency response of the respective microphone and an extensive preliminary measurement and analysis phase. In the analysis, an optimally placed speaker output an audio signal with known characteristics. The microphone signals capturing the audio signal were then analyzed to determine optimum filter settings for each digital filter. The communication system used the same filter settings during its operational lifetime.

The filter settings were also determined based on the estimated or predicted conditions in which the communication system would operate. Thus, the initial measurements and analysis were extensive, but needed to accurately model the conditions in which the communications system would operate. Regardless, age, use, temperature, humidity, altitude, or other factors temporarily or permanently altered microphone characteristics, including frequency response, after the initial determination of the filter settings. Accordingly, the performance of the communication system degraded over time.

Therefore, a need exists for an improved system for compensating for microphone non-uniformity.

SUMMARY

A microphone compensation system maintains performance from communication systems which use multiple microphones. Although the microphone characteristics may change over time, the compensation system effectively tunes the communication system for consistent performance despite the passage of time or the exposure to widely ranging environmental conditions. Furthermore, a lengthy, complex, and costly measurement and analysis phase for determining initial filter settings in the communications system may be avoided.

A microphone compensation system applies microphone input signals to signal adaptation inputs of microphone calibration logic. The microphone calibration logic produces multiple calibrated microphone output signals. The compensation system also beamforms the multiple calibrated microphone output signals. A beamformed output signal results. The microphone compensation system applies the beamformed output signal to the multiple reference signal inputs of the microphone calibration logic. The microphone calibration logic thereby adaptively filters the microphone input signals based on the beamformed output signal to obtain the calibrated microphone output signals.

Adaptation control logic may update the filter coefficients in the adaptive filters. The adaptation control logic may update the filter coefficients when an adaptation criteria is met. The adaptation criteria may be a temperature (e.g., a vehicle temperature), time (e.g., a periodic update schedule), a manual input, an interference level, or any other criteria. Furthermore, the adaptation control logic may ensure that the filter coefficients do not converge towards zero by exercising control of the sum of the filter coefficients for a given sampling interval.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The foregoing features of embodiments will be more readily understood by reference to the following detailed description, taken with reference to the accompanying drawings, in which.

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF SPECIFIC EMBODIMENTS

Figure 1:
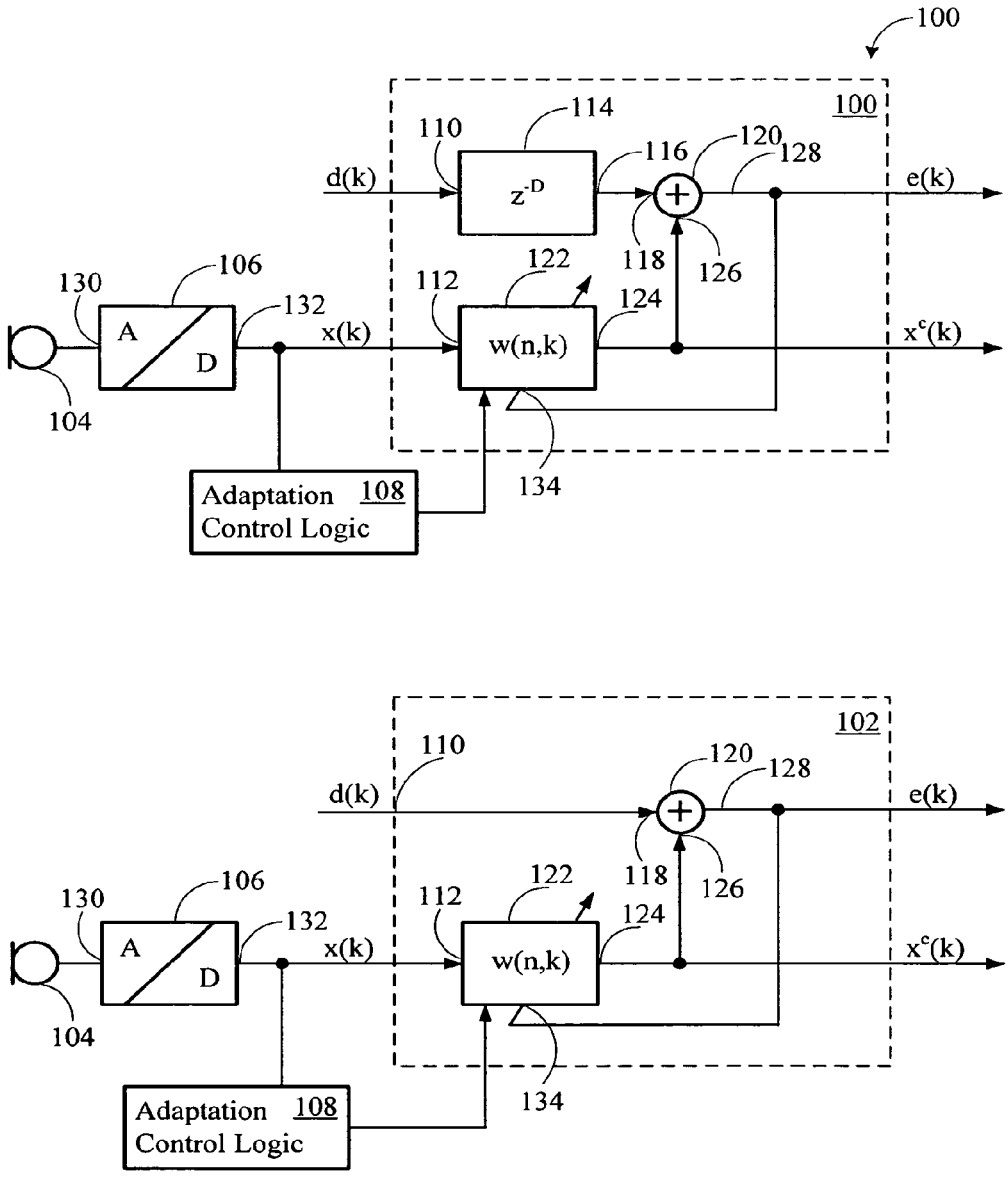
FIG. 1 shows microphone calibration logic operating in conjunction with a microphone, an A-to-D converter, and adaptation control logic.

Definitions. As used in this description and the accompanying claims, the following terms shall have the meanings indicated, unless the context otherwise requires:

FIG. 1 shows two implementations of microphone calibration logic 100 and 102. The microphone calibration logic 100 and 102 connect to a microphone 104, an Analog to Digital (A-to-D) converter 106, and adaptation control logic 108. The microphone calibration logic 100 or 102 may reduce or eliminate the effects of microphone non-uniformities on microphone signals.

The microphone calibration logic 100 and 102 include a reference signal input 110 and a signal adaptation input 112. The reference signal input 110 receives a reference signal d(k). The reference signal input 110 connects to delay logic 114 in the calibration logic 100 and directly to the adder 120 in the calibration logic 102. The delay logic 114 produces a time delayed reference signal on a time delayed signal output 116. The time delayed signal output 116 provides the time delayed reference signal to a first adder input 118 of an adder 120.

In FIG. 1, the signal adaptation input 112 of the microphone calibration logic 100 or 102 accepts a signal which will be adapted, such as a microphone signal, a beamformed signal, or other signal. Thus, the signal adaptation input 112 may act as a microphone signal adaptation input, a beamformer signal adaptation input, or other type of adaptation input. The microphone calibration logic 100 and 102 adapt the signal based on the reference signal applied to the reference signal input 110.

The microphone signal adaptation input 112 connects to a self calibrating filter 122. The self calibrating filter 122 produces a calibrated output signal on an adaptive filter output 124. The adaptive filter output 124 provides the calibrated output signal $x^C(k)$ to a second, inverting, adder input 126. The adder 120 produces an error signal e(k) on an error output 128. The adder 120 combines the time delayed reference signal on the first adder input 118 with the calibrated output signal $x^C(k)$ on the inverting adder input 126 to produce an error signal e(k) on the error output 128. The error output 128 connects to the self calibrating filter 122 on an adaptation input 134.

The microphone 104 provides microphone signals to the A-to-D converter 106 on a microphone signal input 130. The A-to-D converter 106 produces a digital microphone signal x(k) on a digital microphone signal output 132. The digital microphone signal output 132 connects to the adaptation control logic 108 and to the microphone signal adaptation input 112 of the microphone calibration logic 100 and 102. The adaptation control logic 108 connects to the self calibrating filter 122 of the microphone calibration logic 100.

The configuration of the microphone calibration logic 102 varies from that of the microphone calibration logic 100 in that the microphone calibration logic 102 does not include the delay logic 114 or the time delayed signal output 116. In the microphone calibration logic 102, the reference signal input 110 connects to the first adder input 118. Accordingly, the adder 120 combines the reference signal d(k) on the first adder input 118 with the calibrated output signal $x^C(k)$ on the inverting adder input 126 to produce an error signal e(k) on the error output 128.

A signal processing system, such as a hands-free communication system, may use the microphone 104 as one microphone in an array of 'M' microphones. Where a microphone array is used, the signal processing system may also use an array of microphone calibration logic 100 or 102 to calibrate one or more of the microphones in the array. Equation (1) represents the microphone signals $x_m^s(k)$, where m=1, 2, . . . M, s(k) represents identical wanted signal portions, and $n_m(k)$ represents respective interference signal portions:

$$x_m^s = s(k) + n_m(k) \tag{1}$$

The symbol 'k' represents the ordinal number of the sampling period at which the sound signal is converted into a digital form.

Thus, 'k' represents the time interval in the progression of the sound signal $x_m^s$ and equation (1) is a time domain equation. However, the microphone compensation system may process signals in a transformed domain such as the frequency domain, and may incorporate frequency domain adaptive filters or frequency-subband filters. The interference signal portions $n_m(k)$ may represent any potential interference components, such as direction-dependent noise or diffuse noise. The $n_m(k)$ may differ considerably among the individual M microphones.

Equation (1) may represent an ideal electrical output signal of the microphones. In practical applications, microphone-specific characteristics may distort the conversion of a sound signal into an electrical signal. The microphone-specific signal distortions may result from non-uniformities or inconsistent tolerances among the M microphones. Factors such as aging, temperature, humidity, altitude, or other factors may contribute to the varying tolerances and non-uniformities.

A linear model $h_m(k)$ may describe the specific characteristics of the microphones, which may vary over time. Thus, the actual electrical signals obtained by an array of microphones may be described by applying the linear model to the ideal microphone signal samples according to equation (2):

$$x_m^R(k) = x_m^s(k) * h_m(k)$$

Consequently, the actual output signals $x_m^R(k)$ represent multiple microphone signals which may have differing amounts of interference signal portions $n_m(k)$ and/or a different frequency response determined by the coefficients $h_m(k)$.

In practice, the microphones produce the microphone signals $x_m^R(k)$. As described above, any one of the signals $x_m^R(k)$ may represent a non-ideal microphone signal affected by various factors such as aging, temperature, humidity, altitude, or other factors. The microphone 104 communicates the non-ideal microphone signal $x_m^R(k)$ to the A-to-D converter which in turn is communicated to the microphone calibration logic 100 or 102. The A-to-D converter provides a digital microphone signal x(k) on the digital microphone signal output 132.

The microphone calibration logic 100 or 102 receives the reference signal d(k) on the reference signal input 110. The reference signal d(k) may represent one or more microphone signals, a beamformed signal, or other reference signals. The reference signal d(k) may be a digital signal obtained from an A-to-D converter operating, for example, with the same sampling frequency as the A-to-D converter 106. In the microphone calibration logic 100, the delay logic 114 delays the reference signal by a pre-defined number of sampling periods, 'D'. In the microphone calibration logic 102, the reference signal may be communicated directly to the first adder input 118.

The adder 120 combines the reference signal, whether delayed or not, with the calibrated output signal provided by the self calibration filter 122. The error signal e(k) results. The error output 128 on the adder 120 feeds the error output e(k) back to the self calibrating filter 122.

The self calibrating filter 122 includes filter coefficients w(n, k), where n=0 . . . L−1, and L is the length of the self calibrating filter 122. The self calibrating filter 122 filters the digital microphone signal x(k) to produce the calibrated output signal $x^c(k)$. The self calibrating filter 122 optimally matches the calibrated output signal $x^c(k)$ with the reference signal. The reference signal may or may not be delayed by delay logic 114. Equations (3) and (4) represent the calibrated output signal $x^c(k)$ and error signal e(k), respectively:

$$x^c(k)=\Sigma_{n=0}^{L-1} w(n,k)x(k-n) \quad (3)$$

$$e(k)-d(k-D)-x^c(k) \quad (4)$$

Equation (4) represents the error signal in the case in which the reference signal d(k) was delayed by the delay logic 114.

Updating the filter coefficients w(n, k) adapts the filter 122 to changes in microphone characteristics due to age, temperature, humidity, altitude, or other factors. An adaptation algorithm which minimizes the squared error $e^2(k)$ may update the filter coefficients. The algorithm may operate in the time domain, the frequency domain, in a transform domain in the form of a subband filter, or in another manner.

The self calibrating filter 122 may be implemented as a finite impulse response (FIR) filter. The FIR filter may be implemented as a complex-valued fast Fourier transform (FFT)-based filter for processing both amplitude and phase of a signal. By delaying the reference signal d(k) supplied to the microphone calibration logic 100 or 102, non-causal filter behavior of the self calibration filter 122 may be obtained. The microphone calibration logic 100 or 102 provides the calibrated output signal $x^C(k)$ and the error signal e(k) and optimally adapts the frequency response of the microphone 104 to the reference signal d(k). Subsequent processing logic may process the calibrated output signal $.x^C(k)$ and/or the error signal e(k).

The adaptation control logic 108 may selectively activate the recalculation of the filter coefficients w(n, k). The adaptation control logic 108 may trigger the recalculation of the filter coefficients w(n, k) based upon predefined criteria such as the magnitude of the wanted and/or interference signal portions of the microphone signal x(k), the magnitude of the wanted and/or interference signal portions of the reference signal d(k), temperature, time, a manual user request, or upon any combination of these or other criteria.

For example, the adaptation control logic 108 may initiate adaptation using a temperature sensor, a timer, or other sensors or measurement devices. As another example, the adaptation control logic 108 may compare the average amplitude of a specified frequency range, which is expected to include a substantial portion of a wanted signal, with the average amplitude in a different frequency range that is expected to contain a typical interference signal portion. Based on these comparison results, the adaptation control logic 108 may update or refrain from updating the filter coefficients w(n, k). By selectively activating the recalculation of the filter coefficients, the adaptation control logic 108 may avoid generating filter coefficients for the self calibrating filter 122 from a signal having a high interference level.

Figure 2:
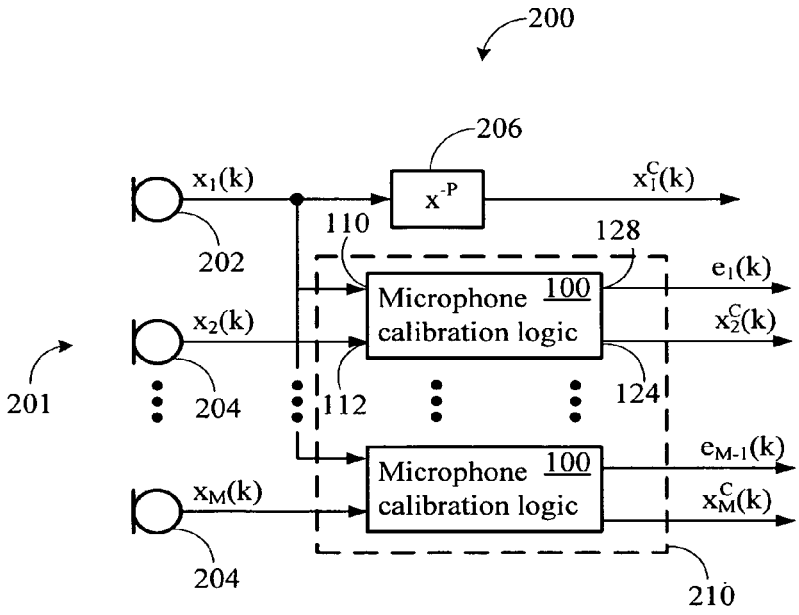
FIG. 2 shows a microphone compensation system.

FIG. 2 shows a microphone compensation system 200. The microphone compensation system 200 includes a microphone calibration logic array 210 and reference delay logic 206 which connect to a microphone array 201. The microphone array 201 includes a reference microphone 202 and additional microphones 204. The microphone calibration logic array 210 includes microphone calibration logic 100 connected to each microphone signal adaptation input 112.

Each microphone in the microphone array 201 may connect to an A-to-D converter that produces digital microphone signals $x_1(k), \ldots, x._M(k)$, where M represents the number of microphones. The reference microphone 202 provides its corresponding microphone reference signal $x_1(k)$ to the reference delay logic 206 and to the reference signal input 110 of each set of microphone calibration logic 100. The reference delay logic 206 produces a delayed microphone reference signal $x_1^C(k)$.

Each of the other microphones 204 provides its respective microphone signal $x_2(k), \ldots, x_M(k)$ to a different microphone signal adaptation input 112 of the microphone calibration logic 100, where M−1 represents the number of sets of microphone calibration logic 100. The system 200 provides calibrated output signals $x_1^C(k), \ldots, x_M^C(k)$ and error signals $e_1(k), \ldots, e_{M-1}(k)$. The output $x_1^C(k)$ corresponds to the delayed microphone reference signal produced by the reference delay logic 206. The outputs $x_2^C(k), \ldots, x_M^C(k)$ correspond to the calibrated signal outputs produced on the adaptive filter output 124 of each microphone calibration logic 100. The error outputs $e_1(k), \ldots, e_{M-1}(k)$ correspond to the error outputs produced on the error output 128 of each microphone calibration logic 100.

The system 200 selects the reference microphone 202 as the source of the reference signal provided to each reference signal input 110. The selection of the reference microphone 202 may be arbitrary. Alternatively, the reference microphone 202 may be selected based on its position or another characteristic. For example, a reference microphone 202 may be positioned such that it produces a microphone signal with a low interference level over many potential environmental conditions. The system 200 uses the microphone calibration logic 100 to adapt the signals produced by the remaining microphones 204 to match the signal produced by the reference microphone 202.

The microphone calibration logic 100 may adaptively filter the microphone signals $x_2, \ldots, x_M(k)$ based on the microphone reference signal $x_1(k)$ in the manner described with respect to FIG. 1 above. The calibrated output signals $x_2^C(k), \ldots, x_M^C(k)$ and corresponding error signals $e_1(k), \ldots, e_{M-1}(k)$ may be used for further processing, such to generate a beamformed, noise reduced, or echo cancelled signal for a communication system. The reference delay logic 206 delays the microphone reference signal $x_1(k)$ by a predefined number of sampling periods. The resulting delayed microphone reference signal $x_1^C(k)$ may be used for further processing along with the calibrated output signals $x_2^C(k), \ldots, x_M^C(k)$.

Figure 3:
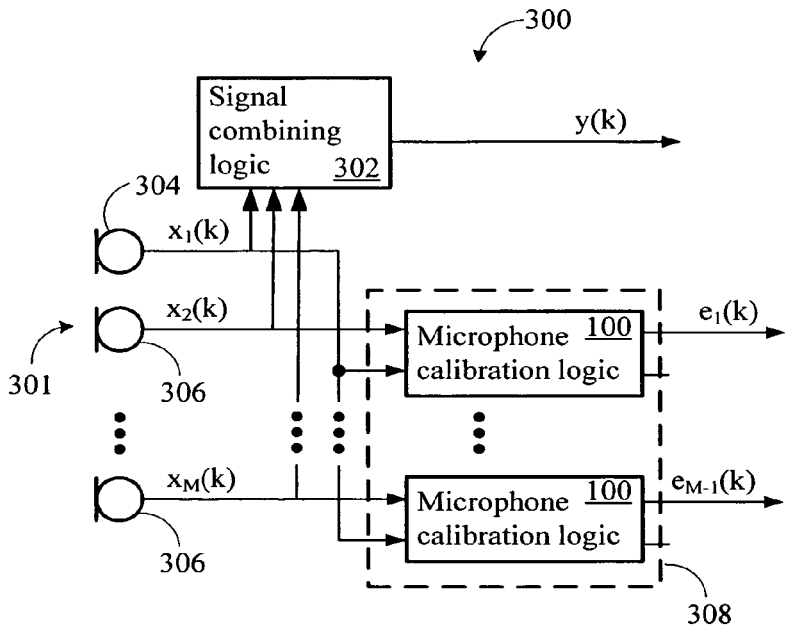
FIG. 3 shows a microphone compensation system.

FIG. 3 shows a microphone compensation system 300 including signal combining logic 302 (e.g., a beamformer). The system 300 is connected to a microphone array 301, including an input microphone 304 and reference microphones 306. Each microphone may connect to an A-to-D converter (not shown) that produces digital microphone signals $x_1(k)$ $x_M(k)$, where M represents the number of microphones. The signal combining logic 302 receives each microphone signal $x_1(k), \ldots, x_M(k)$. The microphone 304 communicates an adaptation microphone signal $x_1(k)$ to the microphone signal adaptation input 112 of each set of microphone calibration logic 100 in the calibration logic array 308.

The multiple reference microphones 306 communicate their respective microphone signals $x_2(k), \ldots, x_M(k)$ to the reference signal input 110 of the M−1 individual sets of microphone calibration logic 100. The microphone calibration logic 100 produces an error signal $e_1(k), \ldots, e_{M-1}(k)$ on their respective error outputs 128. The system 300 derives multiple calibrated output signals from the microphone input signal $x_1(k)$.

The signal combining logic 302 combines the microphone signals $x_1(k), \ldots, x_M(k)$ to provide a combined output signal (e.g., a beamformed signal), indicated as y(k). The output signal may preferentially focus the received sound from the M microphone from one or more spatial directions. The system 300 may implement the signal combining logic 302 as a time invariant beamforming logic, adaptive beamforming logic, or other signal combining logic.

In selecting which microphone among the M microphones will provide the signal to adapt, $x_1(k)$, the same principles described above for the system 200 may apply. The signals provided on the adaptive filter output 124 may or may not be used for further processing, such as beamforming processes. Alternatively or additionally, subsequent processing may instead be based on the error signals $e_1(k), \ldots, e_{M-1}(k)$ and the output signal y(k) provided by the signal combining logic 302.

For example, a generalized side lobe canceller (GSC) may use the output signal y(k) and error signals $e_1(k), \ldots, e_{M-1}(k)$ produced by the system 300. The error signals provided by the system 300 may replace a blocking matrix used in the GSC. The error signals $e_1(k), \ldots, e_{M-1}(k)$ are based on the current filter coefficients and thus the current filter behavior of the respective self calibrating filters 122. Accordingly, the error signals, based upon calibrated microphone signals, may significantly improve GSC operation.

Figure 4:
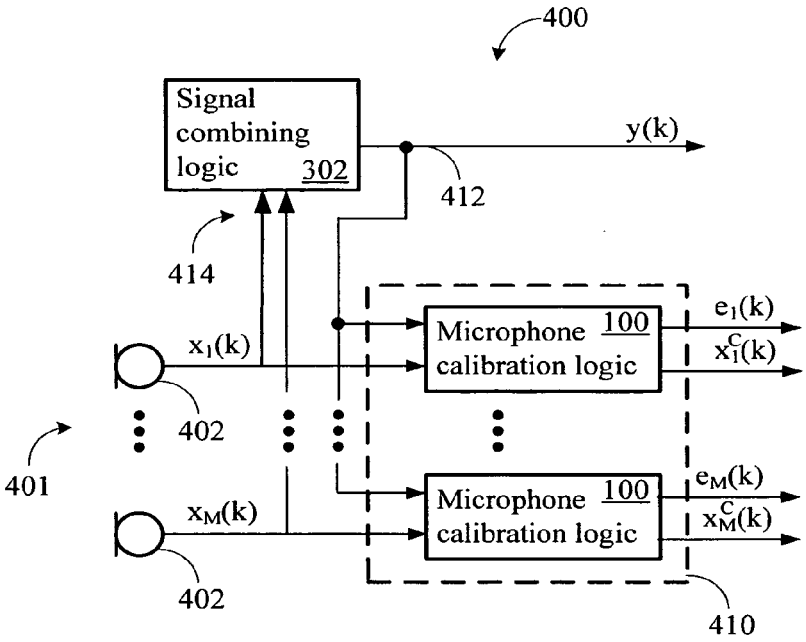
FIG. 4 shows a microphone compensation system.

FIG. 4 shows a microphone compensation system 400 connected to a microphone array 401 of M microphones 402. In this implementation, the signal combining logic 302 provides a combined signal output 412 (e.g., a beamformed signal output) as the reference signal for a microphone calibration logic array 410. The combining logic 302 provides a combined signal (e.g., a beamformed signal) on the combined signal output 412 from microphone signals applied to the beamformer inputs 414. The microphone calibration logic array 410 includes microphone calibration logic 100 for each microphone 402. Each microphone 402 may connect to an A-to-D converter (not shown) that produces digital microphone signals $x_1(k), \ldots, x_M(k)$, where M represents the number of microphones. The microphones provide the microphone signals x1(k), . . . , $x_M(k)$ to the microphone signal adaptation inputs 112 and to the signal combining logic 302 (e.g., a beamformer).

The signal combining logic 302 provides the combined signal output y(k) to the reference signal inputs 110 of the microphone calibration logic 100. One set of microphone calibration logic 100 may be provided for each microphone 402. The system 400 produces calibrated output signals $x_1^C(k), \ldots, x_M^C(k)$ and error signals $e_1(k), \ldots, e_M(k)$ in the manner described with respect to FIG. 1.

Using the combined output signal y(k) to calibrate the microphone signals $x_1(k), \ldots, x_M(k)$ minimizes the influence of individual microphone characteristics on the adaptation process. That is, instead of calibrating based upon a single microphone reference signal, the combined output signal y(k) may provide a more reliable reference signal. As a result, suitable filter coefficients may be obtained even if one or more of the microphones produces signals having a substantial interference portion.

Figure 5:
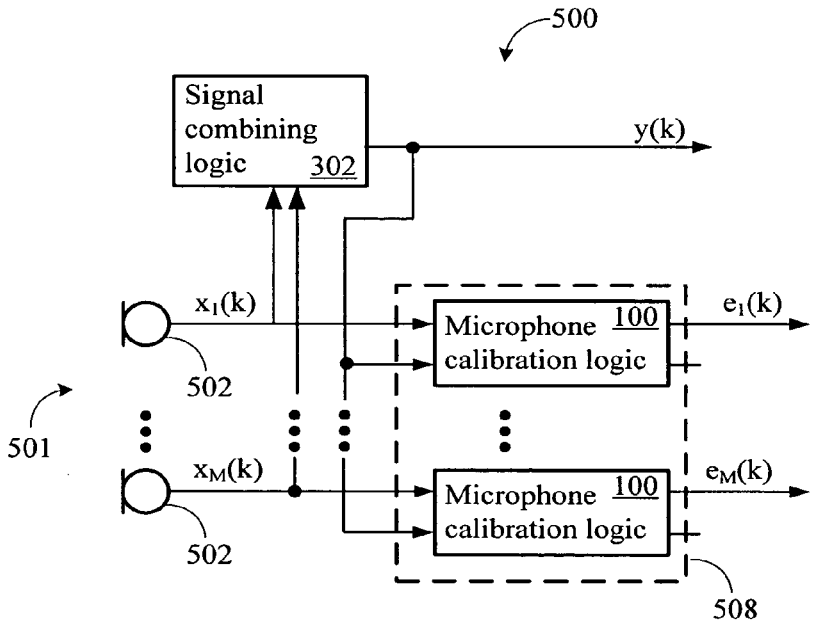
FIG. 5 shows a microphone compensation system.

FIG. 5 shows an alternative implementation of a microphone compensation system 500. In the system 500, the signal combining logic 302 provides a combined signal output, y(k), on the beamformer signal adaptation inputs of the microphone calibration logic 100. The system 500 is connected to a microphone array 501 of M microphones 502. Each microphone 502 may connect to an A-to-D converter that produces digital microphone signals $x_1(k), \ldots, x_M(k)$, where M represents the number of microphones. The microphones provide the microphone signals $x_1(k), \ldots, x_M(k)$ to the reference signal inputs 110 of each set of microphone calibration logic 100 in the calibration logic array 508 and to the signal combining logic 302.

The signal combining logic 302 provides the combined signal output y(k) to the beamformer signal adaptation input 112 of each set of microphone calibration logic 100. The microphone calibration logic 100 determines error signals $e_1(k), \ldots, e_M(k)$ in the manner described with respect to FIG. 1. The system 500 produces multiple calibrated output signals from a single input signal. A GSC may use the output signal y(k) and error signals $e_{1(}k), \ldots, e_M(k)$ determined by the system 500 to significantly improve its operation.

Figure 6:
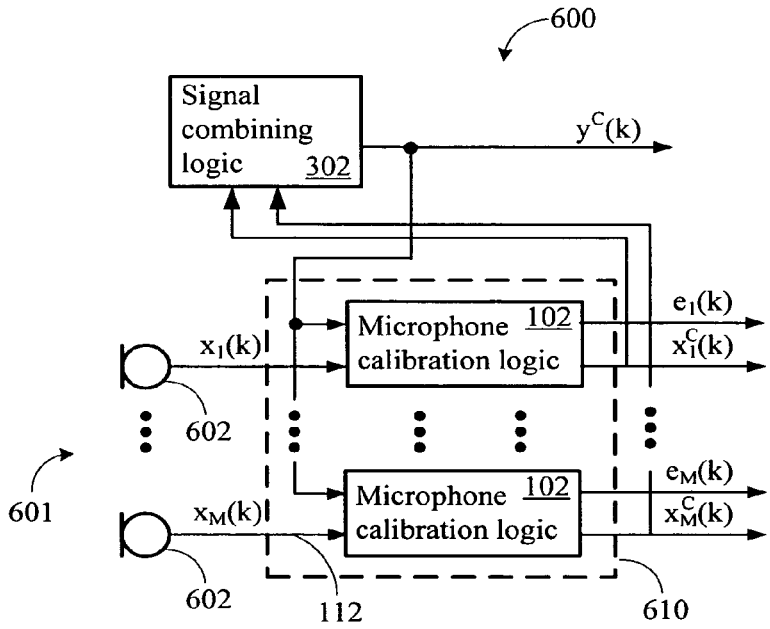
FIG. 6 shows a microphone compensation system.

FIG. 6 shows a microphone compensation system 600 in a closed feedback loop configuration. The system 600 is connected to a microphone array 601 which includes M microphones 602. Each microphone 602 may connect to an A-to-D converter that produces digital microphone signals $x_1(k), \ldots, x_M(k)$, where M represents the number of microphones. The system 600 also includes a microphone calibration logic array 610 with microphone calibration logic 102 connected to each microphone 602. The microphones 602 each connect to a distinct microphone signal adaptation input 112 of a particular microphone calibration logic 102. The microphone calibration logic 102 produces calibrated output signals $x_1^C(k), \ldots, x_M^C(k)$ as described with respect to FIG. 1.

The microphone signal adaptation inputs 112 connect to signal combining logic 302. The signal combining logic 302 combines the calibrated output signals $x_1^C(k), \ldots, x_M^C(k)$ to produce a calibrated combined output signal $y^C(k)$ The signal combining logic 604 provides the calibrated combined output signal $y^C(k)$ to the reference signal inputs 110 for use as reference signals in the microphone calibration logic 102, thereby providing a closed feedback loop.

The closed feedback loop configuration of the system 600 may cause the filter coefficients to converge towards zero. To avoid this effect, the system 600 may exercise additional control over the microphone calibration logic 102. The microphone calibration logic 102 may implement the condition expressed in equation (5) to prevent the filter coefficients of the adaptive filters from converging to zero. In other respects, the modified microphone calibration logic 604 produces calibrated outputs signals $x_1^C(k), \ldots, x_M^C$ and error signals $e_1(k), \ldots, e_M(k)$ as described with respect to FIG. 1.

$$\sum_{m=1}^{M} w_m(n,k) = \begin{cases} 0, & \text{for } n \neq D \\ M, & \text{for } n = D \end{cases} \text{ for any } k, \tag{5}$$

The condition shown in equation (5) ensures that, except at a specified sampling interval, D, the sum of the filter coefficients of the M self calibrating filters 122 equals zero. In this way, at least some of the filter coefficients of each self calibration filter 122 have non-zero values. Due to the condition set by equation (5), the delay logic 114 (present in the microphone calibration logic 100) may be omitted as shown in the microphone calibration logic 102.

Even though a closed feedback loop is established, the condition expressed by equation (5) ensures the stability of the adaptation process. The system 600 benefits from increased efficiency and reliability in responding to changes in microphone frequency responses by using the reference signal derived from the combination of the calibrated signals $y^C(k)$ rather than the initial microphone inputs signals $x_1(k), \ldots, x_M(k)$.

Any of the microphone compensation systems 200-600 may include adaptation logic 108. The adaptation logic 108 may estimate the strength of desired signal content or interference signal content and responsively update the filter coefficients. Other adaptation criteria may be used to determine when the update the filter coefficients, however. As example, the adaptation criteria may include temperature (e.g., vehicle temperature), time (e.g., on a regular basis); manual input, or based on other adaptation criteria.

Figure 7:
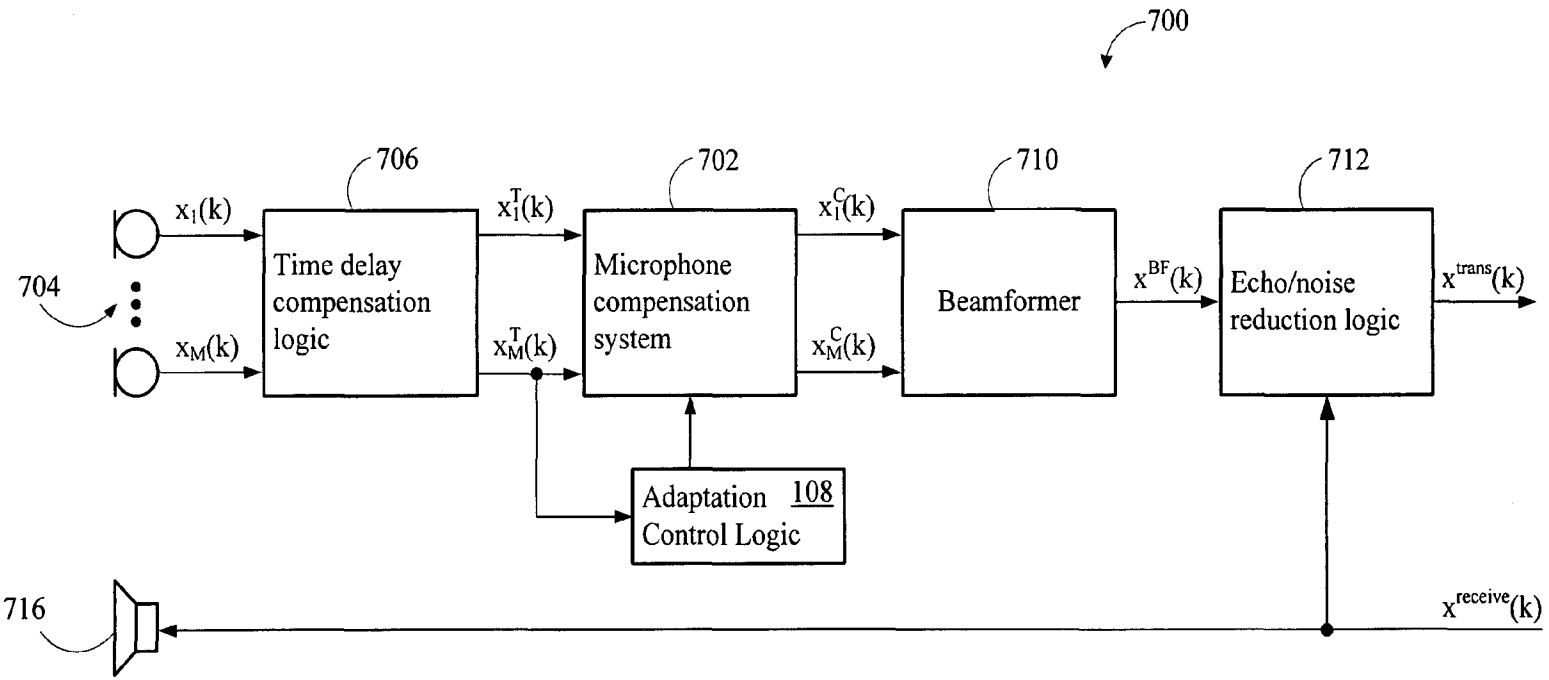
FIG. 7 shows a speech signal processing system including a microphone compensation system.

FIG. 7 shows a speech signal processing system 700 including a microphone compensation system 702. The system 700 includes microphones 704. Each microphone 704 may connect to an A-to-D converter that produces digital microphone signals $x_1(k), \ldots, x_M(k)$, where M represents the number of microphones.

The microphones 704 provide the microphone signals $x_1(k), \ldots, x_M(k)$ to time delay compensation logic 706. The time delay compensation logic 706 produces time delayed microphone signals $x_1^T(k), \ldots, x_M^T(k)$. The time delay compensation logic 706 provides the time delayed microphone signals to the microphone compensation system 702 and to adaptation control logic 108. The adaptation control logic 108 connects to the microphone compensation system 702 and updates the filter coefficients in the adaptive filters in the microphone compensation system 702.

The microphone compensation system 702 produces calibrated output signals $x_1^C(k), \ldots, x_M^C(k)$. The microphone compensation system 702 communicates the calibrated output signals to a beamformer 710. The beamformer produces a beamformed output signal $x^{BF}(k)$ based upon the calibrated output signals.

The beamformed output signal may be provided to subsequent processing stages, such as the echo/noise reduction logic 712. The echo/noise reduction logic 712 produces an transmission output signal $x^{trans}(k)$. The system 700 further includes one or more speakers 716 connected to receive a signal $x^{receive}(k)$. The system 700 provides the receive signal $x^{receive}(k)$ to the echo/noise reduction logic 712 for echo cancellation processing.

Microphone positions relative to a sound source may vary. A time delay between individual microphones may therefore occur, thereby resulting in a relative time delay between the desired signal portions s(k) from the individual microphones. The time delay compensation logic 706 may compensate for the relative time delays between individual microphones 704. The time delay compensation logic 706 may be implemented in the form of adaptive filter elements. The adaptive filter elements may operate as delay paths to synchronize the desired signal portions of the individual microphones 704. However, any other circuitry or logic may compensate for relative time delays in the microphone signals.

Any of the microphone compensation systems 200-600 may implement the microphone compensation system 700. The adaptation control logic 108 operates in the manner described above. The beamformer 710 may be a time invariant beamformer or an adaptive beamformer.

The microphone compensation system 702 may significantly reduce or eliminate the effects non-uniformities of microphone signal characteristics, such as the frequency response of the microphones 704. Due to the adaptive nature of the microphone compensation system 702, the system 700 responds over time to the changing characteristics of the microphones 704. Thus, the system 700 is not limited by fixed, pre-determined filter coefficients. Instead, the system 700 consistently provides high quality audio processing of the microphone signals.

The beamformer 710 provides efficient spatial filtering of the calibrated microphone signals $x_1^C(k), \ldots, x_M^C(k)$. The beamformer may provide a direction-dependent signal damping or gain, for example to dampen interference signal portions. The echo/noise reduction logic 712 reduces echo and noise signal components coupled into the microphones 704 by the speaker 716. The echo/noise reduction logic 712 also reduces stationary interference signal portions. The highly uniformly calibrated microphone signals enhance the beamformer 710 operation, particularly with respect to the frequency response and the spatially selective modification of the microphone signals, regardless of whether a time invariant or an adaptive beamformer 710 used.

The microphone compensation systems 200-600 provide a signal gain of approximately 2 dB or more for frequencies below 1000 Hz. Example parameter values for operating the system 700 are shown in Table 1.

TABLE 1

| Parameter | Value |
|---|---|
| Sampling frequency | 11025 Hz |
| Number of microphones | M = 4 |
| Length of the self calibrating filters | L = 32 |
| Number of delayed sampling intervals | D = 10 |
| Adaptation algorithm: | Normalized Lease Mean Square (NLMS) |
| Processing | Time domain |

Figure 8:
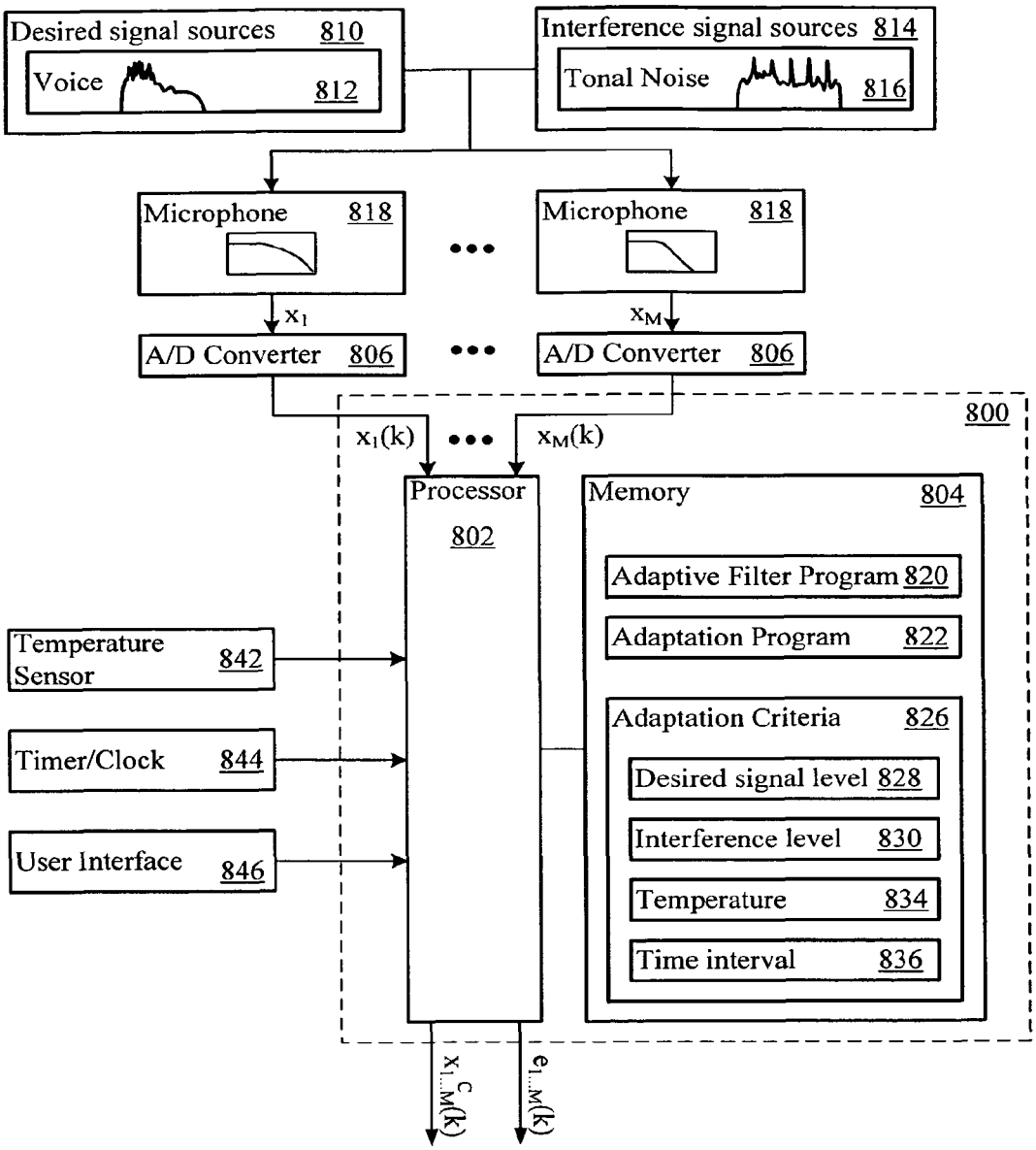
FIG. 8 shows a microphone compensation system.

FIG. 8 shows microphone compensation system 800 including a processor 802 and a memory 804. The processor 802 receives microphone input signals $x_1(k), \ldots, x_M(k)$ from the A-to-D converters 806. The A-to-D converters 806 may be part of or may be separate from the processor 802. Alternatively or additionally, the processor 802 may receive input signal samples from other systems for processing.

FIG. 8 shows desired signal sources 810 (e.g., a voice signal 812) and interference signal sources 814 (e.g., a tonal noise signal 816). The microphones 818 capture the desired signal sources 810 and interference signal sources 814. The voice signal 812, for example, may convey spoken commands to a voice recognition system in a vehicle. In a hands free voice communications system, for example, the voice recognition system may control vehicle components such as windows, locks, audio or visual systems, climate control systems, or any other vehicle component. The interference signal sources 814 may corrupt, mask, or distort the desired signal sources 810. The tonal noise signal 816, for example, produces a noise signal with periodic components. Engine hum or whine, electromagnetic interference, vehicle tires, or other noise sources may generate the tonal noise signal 816.

In practical applications, the microphones 818 have different characteristics, including different frequency responses. The non-uniformities in characteristics may be time variant or time invariant. For example, the characteristics may vary widely depending on age, amount of use, temperature, humidity, altitude, or other factors.

The processor 802 may execute an adaptive filter program 820 and an adaptation program 822. The adaptive filter program 820 may implement any of the microphone compensation systems 200-600 described above. The adaptation program 822 in part implements the adaptation logic 108, which updates the filter coefficients in the adaptive filters when predefined adaptation criteria 826 are met. The predefined adaptation criteria 826 may include a threshold magnitude of the desired signal portion 828 and/or interference signal portion 830 of the microphone input signals or a reference signal. The adaptation criteria 826 may also establish a temperature threshold 834, time criteria 836, or any other adaptation criteria.

A temperature sensor 840 provides temperature data to the processor 800, while a timer 844 provides time and date information to the processor 800. In addition, a user interface 846 provides command input to the processor 800. The command inputs may direct the processor 800 to initiate adaptation of the filter coefficients in the adaptive filters.

The adaptation program 822 may compare the average amplitude of a specified frequency range, which is expected to include a substantial portion of a desired signal, with the average amplitude in a different frequency range, which is expected to contain a typical interference signal portion. Based on the comparison results and the predefined thresholds 828 and 830, the adaptation program 822 may update the filter coefficients and may avoid updating the filter coefficients when a high interference level is present. The adaptation program 822 may also update the filter coefficients when input from the temperature sensor 842 or time 844 meet the adaptation criteria 834 and 836 set in the memory 804.

Figure 9:
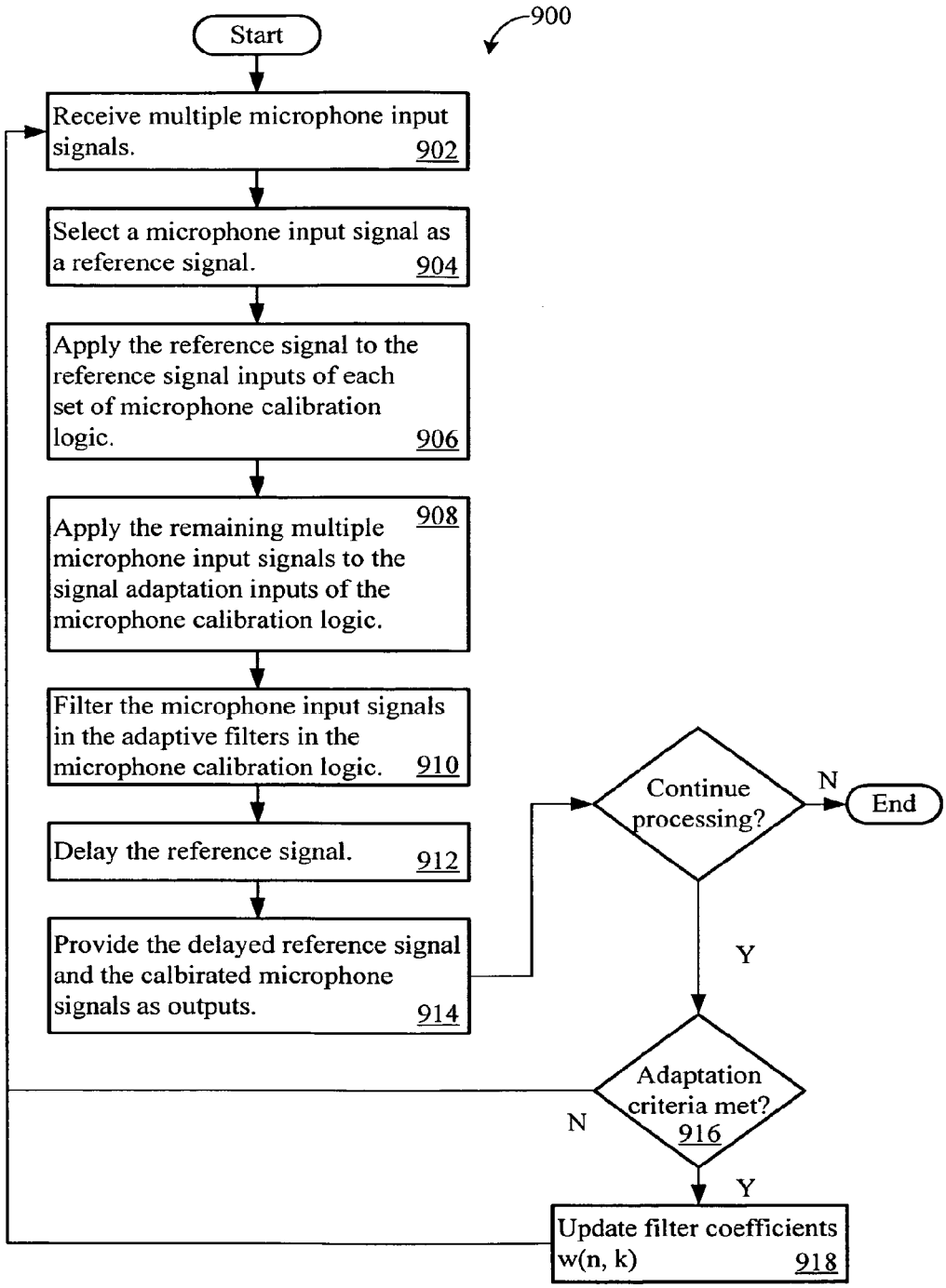
FIG. 9 shows acts which a microphone compensation system may take to compensate signals captured by microphones with different characteristics.

FIG. 9 shows the acts 900 which the microphone compensation system 200 may take to compensate signals captured by microphones with different characteristics. The microphone compensation system 200 receives multiple microphone input signals (Act 902). In a hands-free communications system for an automobile, for example, the microphone compensation system 200 may obtain signals from two or more microphones distributed around the automobile, e.g., in the passenger cabin.

The microphone compensation system 200 selects a microphone input signal as a reference signal (Act 904). The microphone compensation system 200 then applies the reference signal to each of the reference signal inputs of the microphone calibration logic (Act 906). Thus, the microphone calibration logic will attempt to compensate microphone input signals obtained from the other microphones to match the characteristics of the microphone providing the reference signal.

In addition, the microphone compensation system 200 applies the input signals obtained from the other microphones to the signal adaptation inputs of the microphone calibration logic (Act 908). The microphone calibration logic filters the microphone input signals using the adaptive filters (Act 910) to obtain calibrated microphone output signals. The microphone compensation system 200 also delays the reference signal as noted above (Act 912). The delayed reference signal and the calibrated microphone output signals are provided as outputs to subsequent processing systems (Act 914).

FIG. 9 also shows that the microphone compensation system 200 determines whether adaptation criteria are met (Act 916). For example, a microphone compensation system 200 may determine whether ambient temperature adaptation of the adaptive filters. When any adaptation criteria is met, the microphone compensation system 200 updates the filter coefficients in the adaptive filters (Act 918) to meet the changing conditions in which the microphone compensation system 200 operates.

Figure 10:
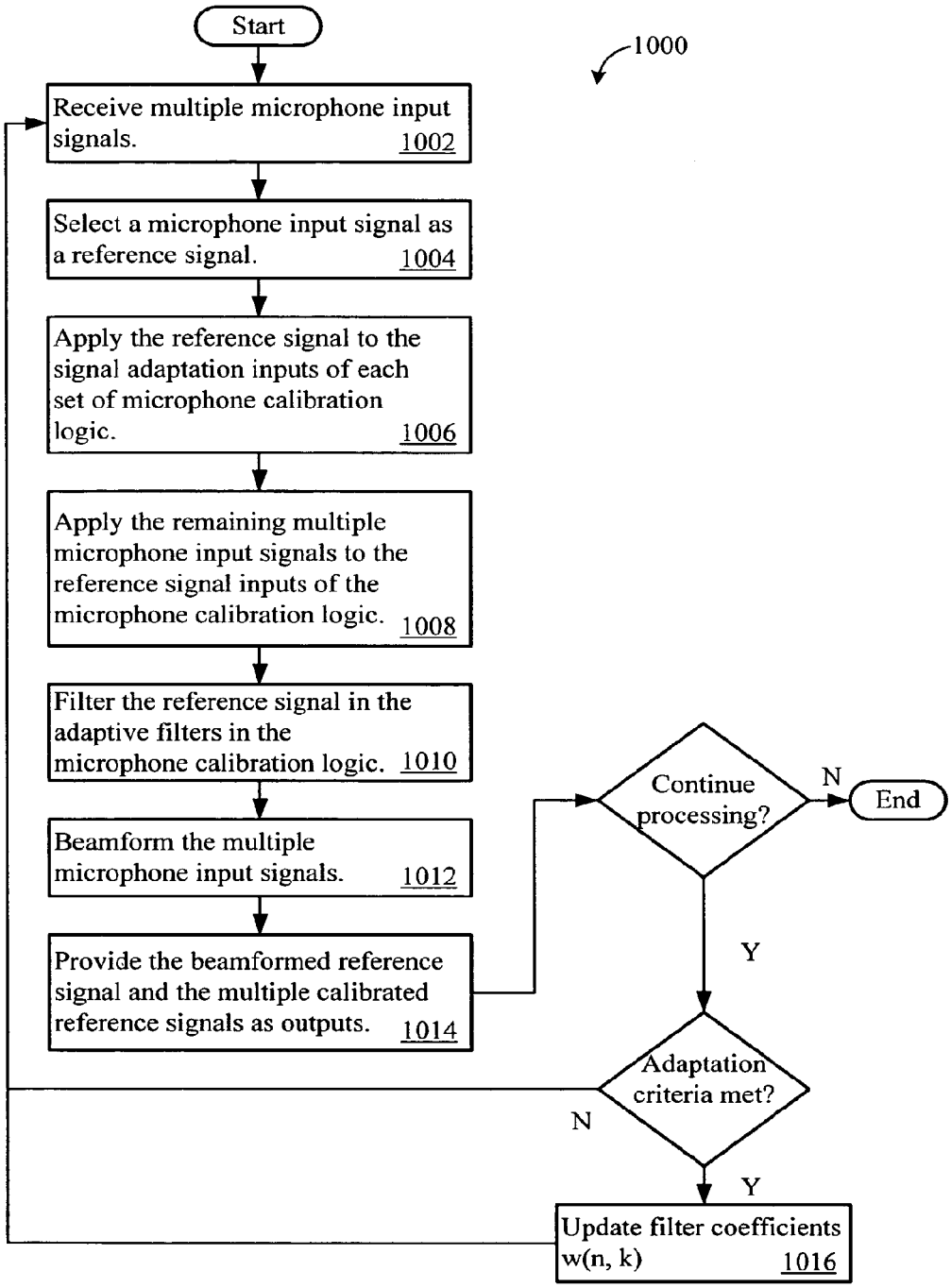
FIG. 10 shows acts which a microphone compensation system may take to compensate signals captured by microphones with different characteristics.

FIG. 10 shows the acts 1000 which the microphone compensation system 300 may take to compensate signals captured by different microphones. The microphone compensation system 300 receives multiple microphone input signals (Act 1002), such as those provided in a hands-free communications system. The microphone compensation system 300 selects a microphone input signal as a reference signal (Act 1004). The microphone compensation system 300 applies the reference signal to each of the signal adaptation inputs of the microphone calibration logic (Act 1006). Thus, the microphone calibration logic compensates the reference signal in different adaptive filters in the microphone compensation system 300.

The microphone compensation system 300 applies the input signals obtained from the other microphones to the reference signal inputs of the microphone calibration logic (Act 1008). The adaptive filters compensate the reference signal based on the input signals obtained from the other microphones to obtain calibrated microphone output signals (Act 1010). In addition, the microphone compensation system 300 beamforms the microphone input signals to form a beamformed output signal (Act 1012). The beamformed output signal and the multiple calibrated reference signals are provided as outputs to subsequent processing systems (Act 1014). Furthermore, adaptation may occur when the microphone compensation system 300 determines that an adaptation criteria is met (Act 1016).

Figure 11:
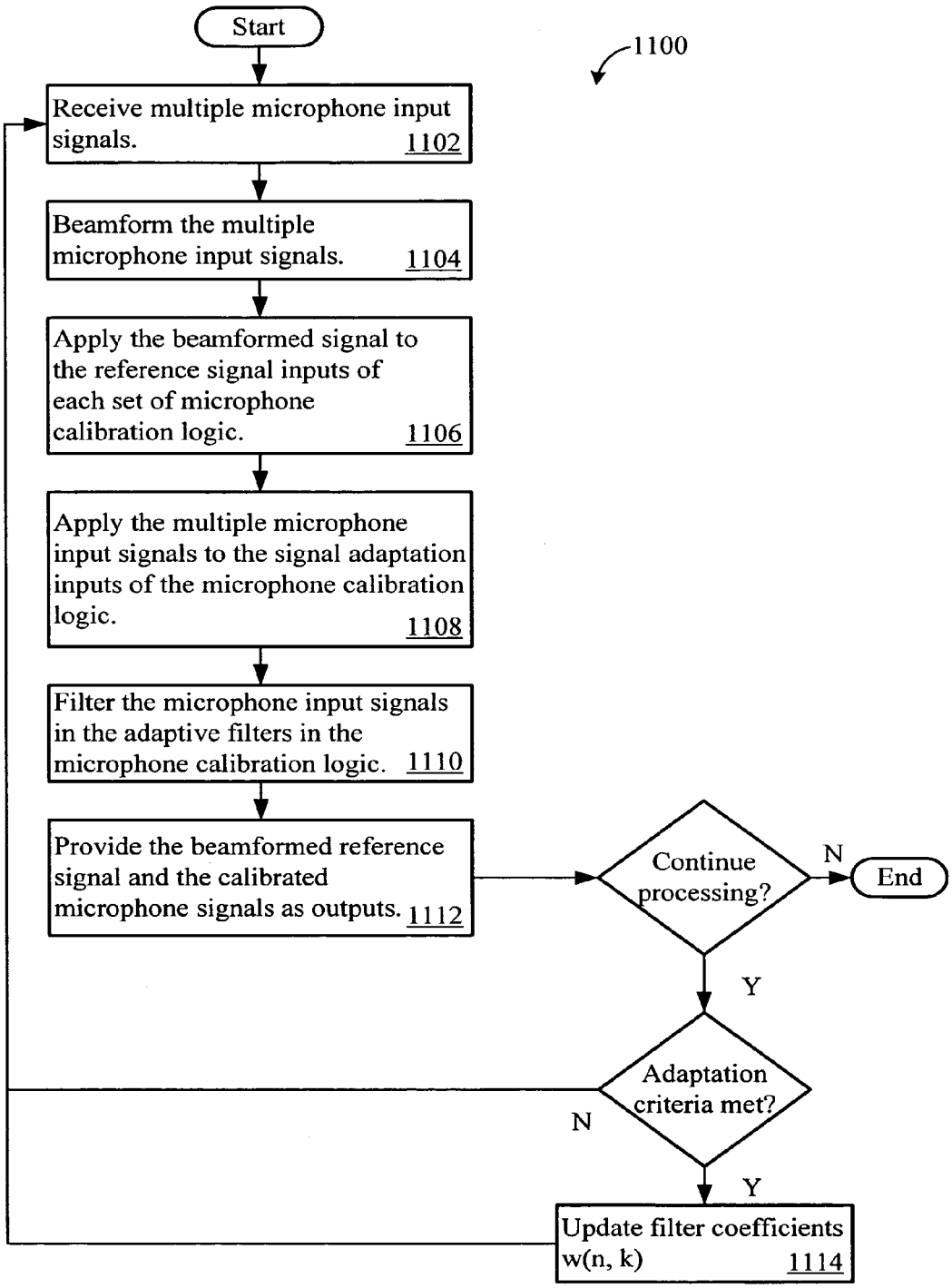
FIG. 11 shows acts which a microphone compensation system may take to compensate signals captured by microphones with different characteristics.

FIG. 11 shows the acts 1100 which the microphone compensation system 400 may take to compensate signals obtained from different microphones. The microphone compensation system 400 receives multiple microphone input signals (Act 1102). The microphone compensation system combines the microphone input signals to obtain a beamformed reference signal (Act 1104).

The microphone compensation system 400 applies the beamformed reference signal to each of the reference signal inputs of each set of microphone calibration logic (Act 1106). The beamformed reference signal thereby provides the standard against which the microphone compensation system 400 will match the microphone input signals. To that end, the microphone compensation system 400 applies the microphone input signals to the signal adaptation inputs of the microphone calibration logic (Act 1108).

The adaptive filters compensate the microphone input signals based on the beamformed reference signal (Act 1110). The beamformed reference signal and the calibrated microphone output signals are provided as outputs to subsequent processing systems (Act 1112). The microphone compensation system 400 may also adapt the filter coefficients when the microphone compensation system 400 determines that an adaptation criteria is met (Act 1114).

Figure 12:
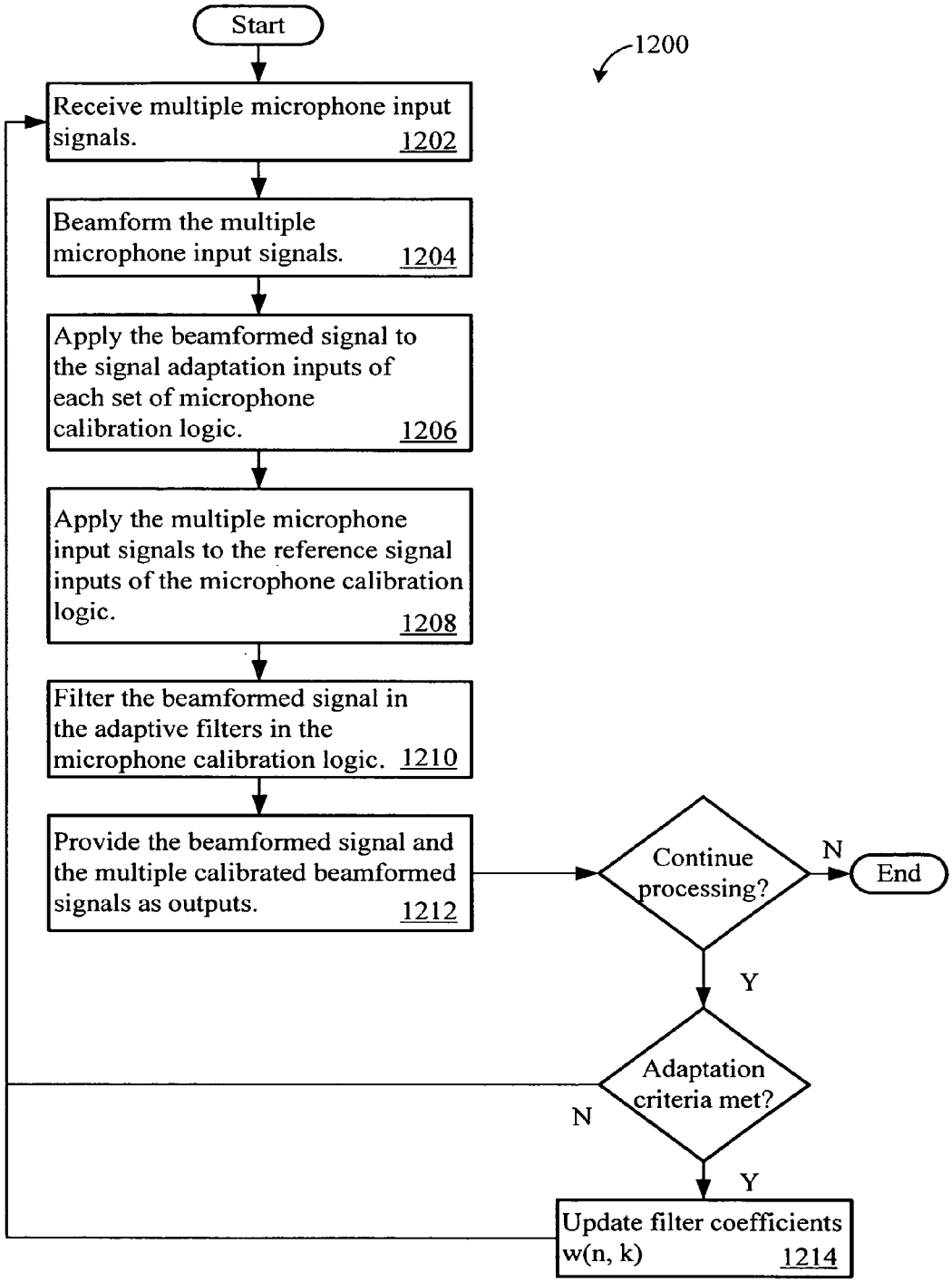
FIG. 12 shows acts which a microphone compensation system may take to compensate signals captured by microphones with different characteristics.

FIG. 12 shows the acts 1200 which the microphone compensation system 500 may take to compensate signals captured by different microphones. The microphone compensation system 500 connects to multiple microphones from which multiple microphone input signals are received (Act 1202). The microphone compensation system combines the microphone input signals to obtain a beamformed signal (Act 1204).

The microphone compensation system 500 applies the beamformed signal to each of the adaptation signal inputs of each set of microphone calibration logic (Act 1206). Thus, the microphone calibration logic compensates the beamformed signal in different adaptive filters in the microphone compensation system 500. The microphone compensation system 500 applies the microphone input signals to the reference signal inputs of the microphone calibration logic (Act 1208).

The microphone input signals thereby provide the reference against which the beamformed signal is matched.

The adaptive filters compensate the beamformed signal based on the microphone input signals (Act 1210). The beamformed reference signal and the multiple calibrated beamformed output signals are provided as outputs to subsequent processing systems (Act 1212). Additionally, the microphone compensation system 500 adapts the filter coefficients when an adaptation criteria is met (Act 1214).

Figure 13:
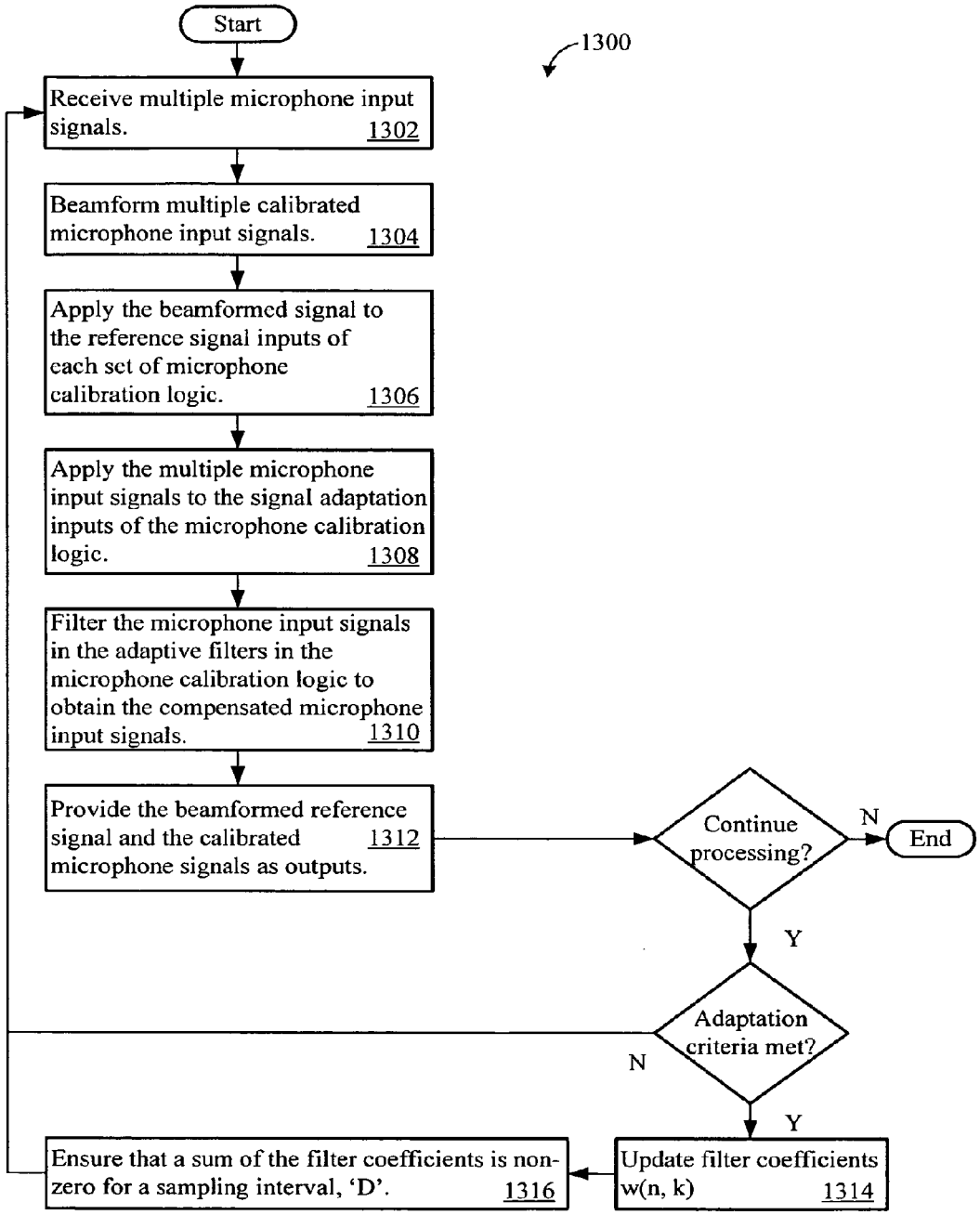
FIG. 13 shows acts which a microphone compensation system may take to compensate signals captured by microphones with different characteristics.

FIG. 13 shows the acts 1300 which the microphone compensation system 600 may take to compensate signals obtained from microphones with different characteristics. The microphone compensation system 600 receives multiple microphone input signals (Act 1302). The microphone compensation system combines multiple calibrated microphone input signals to obtain a beamformed reference signal (Act 1304).

The microphone compensation system 600 applies the beamformed reference signal to each of the reference signal inputs of each set of microphone calibration logic (Act 1306). The microphone compensation system 600 applies the microphone input signals to the adaptation signal inputs of the microphone calibration logic (Act 1308). The microphone input signals are thereby adapted on the basis of the beamformed reference signal, which is a combination of previously calibrated microphone input signals.

The adaptive filters compensate the microphone input signals based on the beamformed reference signal (Act 1310). The calibrated microphone input signals result. The beamformed reference signal and the multiple calibrated microphone output signals are provided as outputs to subsequent processing systems (Act 1312). Additionally, the microphone compensation system 600 adapts the filter coefficients when an adaptation criteria is met (Act 1314). As described above, the microphone compensation system 600 ensures that the sum of the filter coefficients is non-zero for a sampling interval, 'D' (Act 1316).

The microphone compensations systems described above update the filter coefficients to adjust for the changing characteristics of the microphones. Thus, the microphone compensation systems provide flexible compensation to microphone non-uniformities. Moreover, lengthy and complex measurements for an initial determination of time-invariant filter coefficients may be avoided.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A method comprising:

receiving a plurality of input signals emanating from a plurality of microphones and having different frequency responses caused by non-uniformities of said microphones;

generating a reference signal within signal combining logic;

adaptively filtering within microphone calibration logic at least one of the plurality of input signals on the basis of said reference signal to at least partially compensate for the non-uniformities of the microphones, wherein the reference signal is generated by a combination of at least a plurality of the input signals; and adaptively filtering includes supplying the at least one input signal to an adjustable filter to provide a filtered signal, and adapting said filter on the basis of a difference of the filtered signal and the reference signal.

2. The method of claim 1, wherein said adjustable filter is represented by a FIR or IRR filter.

3. The method of claim 2, wherein said reference signal is delayed prior to generating the difference of the filtered signal and the reference signal.

4. The method of claim 2, wherein said adjustable filter is implemented in the time domain or in the frequency domain, in particular, as frequency subband filter.

5. The method of claim 2, wherein said adjustable filter is implemented as complex-valued filter.

6. The method of claim 1, wherein combining the at least some of the input signals includes processing the at least some of the signals by a time-invariant beam former.

7. The method of claim 1, further comprising:

selecting two or more of the input signals as respective distinct reference signals, each of the distinct reference signals being used to adaptively filter said at least one input signal to generate two or more error signals.

8. The method of claim 7, further comprising:

combining said two or more reference signals and the at least one input signal to generate a single output signal.

9. The method of claim 1, further comprising:

compensating for sound propagation differences created by a common sound source for the plurality of microphones prior to receiving said input signals.

10. The method of claim 1, further comprising:

estimating the magnitude of a wanted signal portion in one or more of said input signals.

11. The method of claim 10, further comprising:

adaptively filtering said at least one input signal based on the estimated magnitude of the wanted signal portion.

12. The method of claim 1, further comprising:

estimating a magnitude of an interfering signal portion in one or more of said input signals.

13. The method of claim 12, wherein adaptively filtering is performed on the basis of the estimated magnitude of the interfering signal portion.

14. The method of claim 12, wherein adaptively filtering is performed on the basis of the estimated wanted signal portion and the estimated interfering signal portion.

15. The method of claim 1, further comprising:

generating a plurality of output signals to be beam-formed, on the basis of the at least one adaptively filtered input signal and/or the reference signal and/or a difference of the at least one adaptively filtered input signal and the reference signal.

16. The method of claim 15, further comprising:

beam-forming said output signals by an adaptive beamformer to produce a spatially selectively modified microphone signal from the plurality of input signals.

17. The method of claim 16, further comprising:

reducing echo and/or noise components of said spatially selectively modified microphone signal.

18. A microphone calibration system comprising:

a plurality of microphone calibration units each comprising:

a microphone configured to produce a microphone signal having a characteristic frequency response, an analog/digital converter having an input for receiving said microphone signal and an output for providing a digital microphone signal, an adaptive filter having an input to receive a digital input signal, an output for outputting a filtered signal and an adaptation input, a reference signal generator, and an adder having a first input connected to said reference signal generator, a second inverting input connected to the output of the adaptive filter and an output connected to the adaptation input of the adaptive filter; and a signal combiner connected to the plurality of microphone calibration units and configured to receive the microphone signals and to provide an identical reference signal to each of the adaptive filters.

19. The microphone calibration system of claim 18, wherein each of said adaptive filters of each of the plurality of microphone calibration units comprises a digital FIR or a digital IIR filter.

20. The microphone calibration system of claim 18, wherein said adjustable filter is implemented in the time domain or in the frequency domain, in particular, as frequency-subband filter.

21. The microphone calibration system of claim 18, wherein said adjustable filter is implemented as complex-valued filter.

22. The microphone calibration system of claims 18, wherein said reference signal generators include a delay path to delay said respective digital microphone signals by a predefined number of sampling periods.

23. The microphone calibration system of claim 18, further comprising a signal estimator for estimating a wanted signal portion in at least one of the microphone signals.

24. The microphone calibration system of claim 23, further comprising:

filter updating module for selectively activating the updating of filter coefficients of the adaptive filters.

25. The microphone calibration system of claim 24, wherein said means for selectively activating the updating of filter coefficients are configured to activate the updating on the basis of a result of the means for estimating a wanted signal portion.

26. The microphone calibration system of claim 18, further comprising:

A beam-former configured to provide a single spatially modified microphone signal on the basis of output signals of the adder and/or the adaptive filters and/or analog/digital converters.

27. The microphone calibration system of claim 18, further comprising:

time delay compensation module configured to compensate for a relative time delay in the microphone signals when the microphone are excited by a single sound source.

28. The microphone calibration system of claim 27, further comprising:

an echo and noise reduction module configured to reduce echo components and/or stationary noise in said single spatially modified microphone signal.

* * * * *